United States Patent [19]

Kushida et al.

[11] 3,963,589

[45] June 15, 1976

[54] PROCESS FOR THE MANUFACTURE OF A DECORATIVE ALUMINUM PRODUCT

[75] Inventors: Hachiro Kushida, Higashi-yamato; Tsuneji Takasugi, Iruma; Shinji Ikeda, Tokyo; Takashi Shiono, Chofu, all of Japan

[73] Assignee: Citizen Watch Co., Ltd., Tokyo, Japan

[22] Filed: Dec. 28, 1973

[21] Appl. No.: 429,291

[30] Foreign Application Priority Data

| | | |
|---|---|---|
| Feb. 26, 1973 | Japan | 48-22917 |
| May 31, 1973 | Japan | 48-60323 |
| June 9, 1973 | Japan | 48-64932 |
| June 26, 1973 | Japan | 48-72019 |

[52] U.S. Cl. ..... 204/29; 204/35 N; 204/36; 204/58

[51] Int. Cl.[2] ..... C25D 11/16; C25D 11/18

[58] Field of Search ..... 204/29, 36, 58, 35 N; 156/272

[56] References Cited

UNITED STATES PATENTS

| | | | |
|---|---|---|---|
| 2,941,282 | 6/1960 | Fromson | 29/195 |
| 2,941,930 | 6/1960 | Mostovych et al. | 204/29 |
| 3,076,706 | 2/1963 | Daugherty | 204/58 |

*Primary Examiner*—R. L. Andrews
*Attorney, Agent, or Firm*—Holman & Stern

[57] ABSTRACT

The invention concerns a process for the manufacture of a decorative aluminum alloy product such as a watch case. In the first step, several aluminum sheets are united tightly into a stock by their overlapping and pressure-welding. The compacted stock is subjected to a forging step for agitating substantial part of the composite stock in its regularly laminated structure. Then, a watch case material is punched out from the composite stock which is further subjected to an anodically oxidizing step and a mirror finish step to provide the final product. The invention relates also the thus finished final product, having an attractive and contrasted flow design pattern on its exposed surface and in any section thereof.

6 Claims, 12 Drawing Figures

FIG. 8 (III)

PROCESS FOR THE MANUFACTURE OF A DECORATIVE ALUMINUM PRODUCT

BACKGROUND OF THE INVENTION

This invention relates to decorative aluminum alloy products and a process for the manufacture of same. These products have a miracle and attractive surface and sectional appearance similar in its substance to a wooden or marble board. In addition, these products have an anticorrosive and wear-resistant surface.

It is broadly known to produce an anticorrosive and wear-resistant surface by anodizing or anodically oxidizing treatment of aluminum alloys.

This oxide surface layer can be colored variously by use of dyestuffs. Color shades of bronze tone can be also electrolytically produced on such oxide surface layer by suitably selecting the composition of the aluminum alloy and the electrolyte. These colored aluminum or aluminum alloy materials and products have various usage fields such as from decorative building materials to miracle personal accessories.

Various processes are known to provide a design pattern effect on these colored aluminum materials and products.

A simplest method adopted for this purpose is to apply partially the pigment color printing. A further method resides in a partial etching of a clad board consisting of two or more different aluminum alloy sheet elements for the formation of irregular recesses of different depths, thereby producing difference in color depending upon the alloy composition of the exposed layer. In this respect, reference may be had to U.S. Patent Application Ser. No. 314,319 (1963).

It is further known to produce a crystal grain pattern through the way of etching, as disclosed in the specifications of U.S. Pat. No. 2,941,930 and U.S. patent application Ser. No. 154,475 (1971).

A common feature to these several known processes resides in the preparation of plane decorative sheets or boards and thus, they can not be applied to three-dimensional products. In addition, the thus obtained design pattern is rather monotonous. It is therefore inhibitingly difficult to provide a highly miracle and attractive complexed light-and-dark design pattern in resemblance to natural wood grain or marble-like appearance onto the surface of a three-dimensional product by reliance to these known process. It is further impracticable to provide a mirror finish to such decorative surface by virtue of the disappearance of the surface design pattern during the finishing operation.

SUMMARY OF THE INVENTION

It is therefore a main object of the present invention to provide a decorative aluminum alloy product representing a miracle and attractive design pattern in resemblance to natural wood grain or marble and a mirror finish.

A further object is to provide the above kind of products which have an anticorrosive and wear-resisting performance.

Still further object is to provide an efficient process for the manufacture of the above novel aluminum alloy products.

Throughout the specification, it should be noted that the term "aluminum alloy" includes pure aluminum.

In the process according to this invention, aluminum alloy sheets of different alloy compositions are united together, mechanically or metallurgically or both, into a composite piece, preferably, in the form of a board, sheet or even a bar. This united stock is prefabricated into a watch dial, watch casing, cuffbutton or the like product which is then subjected to an anodic oxidizing treatment for the formation of an aluminum oxide layer on the surface of the semiproduct, which surface is dyed, pore-sealed and further subjected to a mirror finish. Before the prefabrication step, the laminated composite stock is preferably subjected to a mechanical processing step, such as a partial punching-, an extruding-, a forging-, a swaging or the like step for agitating at least partially the regular lamination structure of the composite mass, so as to invite turbulent material flows, as will be seen, by way of example, at a glance of FIG. 3 to be described.

The semiproduct is then subjected to an anodic oxidizing treatment for the formation of aluminum oxide layer on the surface thereof, and to coloring, pore-filling and mirror-finishing steps for providing the finish product.

In place of the use of the alloy sheets, alloy bar or the like stocks may be cut into small pieces which are then mechanically united together by extrusion, so as to provide the composite mass. Or alternatively, several different aluminum alloy materials are finely divided and then separately semisintered to provide several corresponding sintered masses which are granuled, mixed together and charged into a mould and hot-pressed in an inert atmosphere to provide a composite mass for prefabrication as before.

Other several modes of the manufacturing process according to this invention will become more apparent by reference to several preferred Examples thereof to follow and of the appended several claims.

These and further objects, features and advantages of the invention will become more apparent when read the following detailed description of the invention by reference to the accompanying drawings illustrative of several preferred embodiments of the invention.

DETAILED DESCRIPTION OF THE INVENTION

In the following several preferred Examples of the invention will be set forth for better and more specific understanding of the invention, and by reference to the accompanying drawings. In the following, the naming of aluminum alloys are those prescribed by JIS (Japanese Industrial Standard).

EXAMPLE 1

Figure 1A:
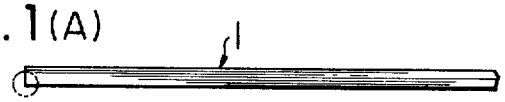
FIGS. 1(A), 1(B) and 2 are explanatory drawings for the illustration of the manufacturing mode of the decorative board according to this invention and in accordance with Example 1 to be described.
Figure 1B:
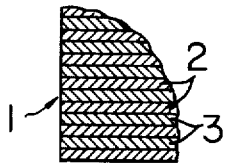

Two kinds of metallic sheet stocks, twenty four in number, made of aluminum alloys "5005" and "6061", each having a thickness of 1 mm, were stacked alternately together and then rolled under heavy pressure through several tens passes with each 10% thickness reduction, into one tightly united and composite multilayer board 1, 1 mm thick, which is shown schematically in FIG. 1 at (A) and (B) in its side view and in an enlarged partial section, respectively. As may be seen, this composite board 1 consisted of a plurality of, more specifically twenty four, alternately different alloy material layers 2 and 3, extending substantially parallel in the lengthwise and lateral directions of the composite and laminated board.

Figure 2:
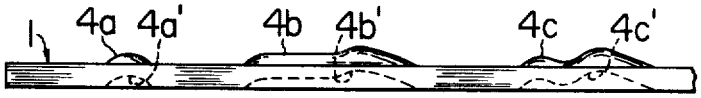

The next following step is illustrated in FIG. 2. The laminated board 1 was formed at this stage with impressions of irregular shape and depth, as shown by way of examples at 4*a*', 4*b*' and 4*c*' on the lower surface, in this specific embodiment, in the lower or bottom surface of the board 1 by application of localized substantial pressure by rolling, pressing or punching technique. The opposite, or upper surface, in this specific embodiment, of the board 1 was formed with corresponding reliefs, as shown at 4*a*, 4*b* and 4*c* in FIG. 2.

In order to form these reliefs, the sheet stock 1 was passed through a small gap formed by and between a metallic roll formed on its surface with similar reliefs or projections as above, and a pliable roll made preferably of hard rubber. As an alternating measure, the sheet stock 1 can be subjected to a coining step on a die press machine.

Figure 3:
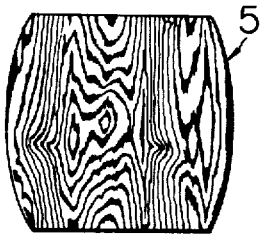
FIG. 3 is a manual reproduction of a photograph showing a plan view of a watch dial plate stock made from the decorative board prepared in accordance with Example 1 to be described, wherein, however, the light-and-dark contrast has been strongly accentuated.

As a further step, a decorative plate, such as a watch dial, was punched out from the laminated board 1 and the reliefs 4*a*, 4*b* and 4*c* were removed off by grinding. Then, the dial stock was anodically oxidized in the similar manner as will be described in Example 2. In FIG. 3, a sample of the grained decorative appearance of the thus treated finished product or watch dial 5. In this case, the exposed parts of aluminum alloy 5005 represented a light bronze color tone, while those of aluminum alloy 6061 showed a dark bronze color tone, thanks to the anodic treatment.

EXAMPLE 2.

Figure 4:
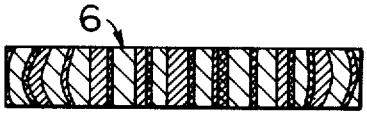
FIG. 4 is a schematic cross-section of a composite material prepared in the mode as described in Example 2 to be described, wherein, however, the material flows have been highly simplified for clear graphical representation.

Aluminum alloy sheets 3003, 5005 and 6061, total 30 sheets of any selected combination, were extruded from a die and then rolled under pressure to a sheet stock 8.5 mm thick and 50 mm wide and 2 m long. In FIG. 4, at 6, this sheet stock is shown only schematically in its cross-section.

Figure 5:
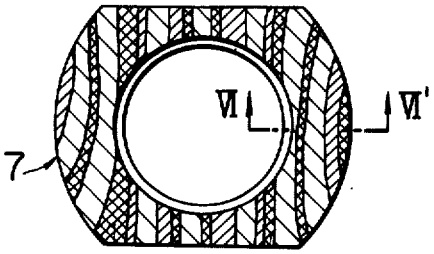
FIG. 5 is a schematic plan view of a watch case prepared from the composite material shown in FIG. 4, with the material flows highly simplified.
Figure 6:
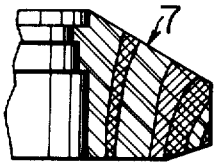
FIG. 6 is a schematic partial section taken substantially along a section line VI – VI′ shown in FIG. 5, with the material flows highly simplified.

By forging and cutting mechanically, a watch case, as shown in FIGS. 5 and 6 at 7 was fabricated and then subjected to degreasing and an anodically oxidizing treatment under the following conditions:

1. degreasing treatment by dipping the machined products in a 7%-caustic soda aqueous solution for 1 – 2 minutes;
2. anodic oxidizing treatment by use of a 10%-sulfuric acid solution (0° – 10°C) for 60 minutes; current density: 2 amp./dm$^2$; batch: 100 pieces.
3. dyeing treatment: ferric ammonium oxalate aqueous bath, 20 grms/1,000 c.c., 60°C, 10 minutes.
4. pore-filling treatment: using pure fresh water, 90°C, 30 minutes.

By performing the above treatments, the watch case was formed on its surface with an oxide layer, about 60 microns thick, representing yellow-, light bronze- and dark bronze color tone, respectively, in the order of the above-mentioned component alloy layers.

Then, the watch case was mirror-polished with alumina and diamond fine powder.

In FIGS. 5 and 6, wood-grain like color tone thus obtained on and in the finish product is shown only schematically.

Upon executed experiments for an extended period, such as several months, the thus finished watch case was proved to have an efficient antocorrosive and scratch proof performance.

In the present Example, the material alloy sheets were stacked one after another, extruded and machined to provide a laminated board. Instead, however, several different alloy bar or wire stocks can be combined, extruded or swaged to provide a composite bar stock which can be used for the similar purpose as above.

EXAMPLE 3

Figure 7:
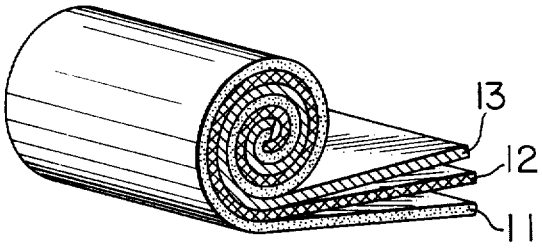
FIG. 7 is a perspective view for the illustration of the manufacturing mode of a composite material as described in Example 3.

Three different aluminum alloy sheet stocks 3003, 5005 and 6061 were coiled together as schematically shown in FIG. 7, having a coil diameter of about 30 mm. The sheet stocks are denoted with numerals 11, 12 and 13, respectively, in FIG. 7.

In this case, a clad sheet from two or more different alloy sheet elements could be used for coiling, if necessary.

The coil was then hot-swaged into a tight mass in the form of a composite round bar stock of a diameter: 15 mm. When the coil diameter is relatively large, extrusion may, more conveniently for mass production purpose, be adopted in place of swaging.

Figure 8I:
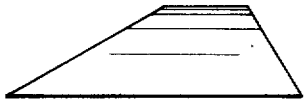
FIG. 8 shows at (I), (II) and (III) a sleeve-link or cuff button prepared from the composite material illustrated in FIG. 7 and in its plan and both side views, wherein, however, the material flows have been omitted for clear graphical representation.
Figure 8:
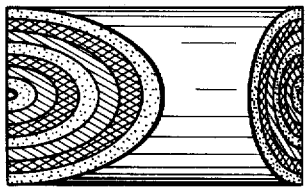
Figure 8:
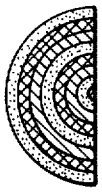

As a next step, the composite bar stock was machined as conventionally to provide a decorative intermediate product, such as cuff button, as shown at (I), (II) and (III) in FIG. 8, and processed through degreasing, anodic oxidation, dyeing, porefilling and mirror polish treatments as described in the foregoing Example 2.

The thus obtained decorative product showed a sharp and beautiful grain appearance in resemblance to the natural one of a hard wood, as schematically illustrated in FIG. 8 at (I), (II) and (III).

The grain-like design can be still further accentuated towards complexity and delicacy, by adopting a forging step in addition to the aforementioned several machining steps.

EXAMPLE 4

Sheet stocks and bar stocks of aluminum alloy 3003 were cut mechanically into 650 small irregular shaped pieces, 50 – 200 mm long, 20 – 50 mm wide and 1 – 10 mm thick, and placed in a mould of cast iron. Then, a molten aluminum alloy 6061 weighing 5 kg, was charged into the mould, so as to fill the idle space gaps among the preintroduced solid pieces, thus providing a composite ingot, 9 kg, which was, upon solidified, extruded from dies, 30 mm o, and 10 × 50 mm, respectively, to provide bars and sheets, each about 2 m long, of composite structure.

From these composite bar and sheet stocks, decorative intermediate products were fabricated as before, and then surface-treated as in the foregoing Example 2. The surface, as well as section of any one of these products represented a beautiful and indefinite flowing grain-like design similar to marble.

EXAMPLE 5

Aluminum alloys 1100; 5005 and 6061 were finely divided for providing corresponding powders, of 10 – 50 micron particle sizes, which were then added each with a proper quantity of a binder, preferably ethylene glycol. These powders were named P, Q and R in the above order, respectively.

Figure 9:
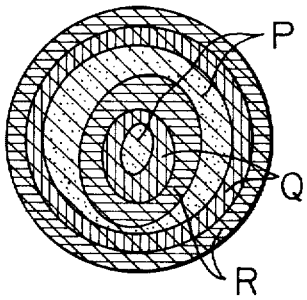
FIG. 9 is an enlarged schematic cross-section of a composite multilayer particle as prepared in the mode to be described in Example 5.

The first kind powder P was processed in a granulator to provide granules of about 0.5 mm particle size in the mean. Then, 200% and 400% quantities of the second and third powders Q and R as measured relative to the quantity of the first powder P were successively added to the granulator, so as to form an intermediate and an outer layer Q and R on the first core P. Similar procedures were repeated until five layers were deposited on the core, as shown schematically in an enlarged scale in FIG. 9. Each of the thus formed multilayer granules had diameters amounting to 1.5 – 3.0 mm. The final granule had a shell-like multilayer structure as shown by way of example, comprising a core P and several outer layers P, Q and R.

These multilayer granules were charged in a female mould and compacted under pressure of 30 kg/mm² into a single mass and sintered 500°C in an inert atmosphere of argon gas for about 1 hour, to provide a door handle weighing 200 grms.

This sintered door handle stock was finish-machined on a lathe, and then subjected to anodic oxidizing, dyeing and mirror-finish treatments in the similar way as described in Example 2. The finished product represented a briar-like design pattern on its exposed surface, as well as in any section thereof, although somewhat different from each other.

EXAMPLE 6

Figure 10:
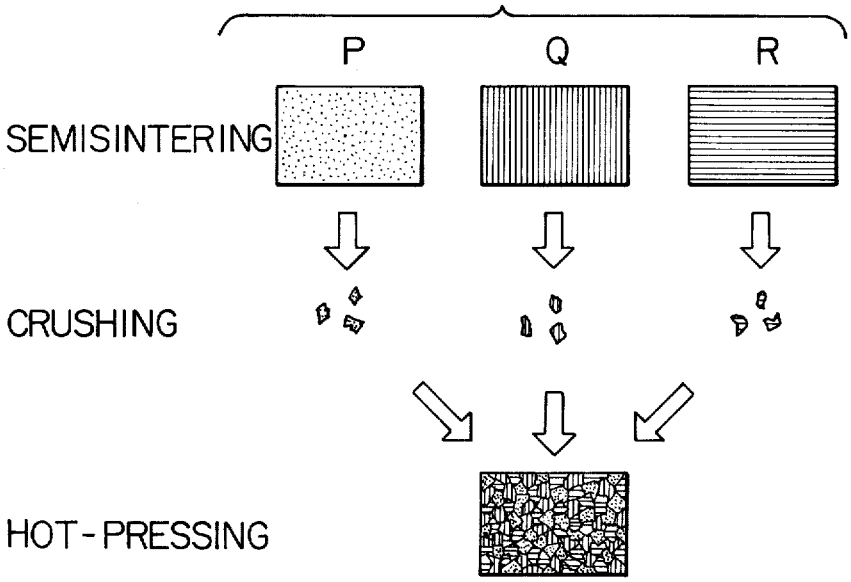
FIG. 10 is a schematic explanatory view for the illustration several manufacturing steps for the preparation of a sintered material in the mode to be described in Example 6.

Aluminum alloys 1100; 5005 and 6061 were finely divided to respective powders, having particle sizes 50 – 100 microns. These three kinds of powder were separately compacted under pressure as before and semisintered, separately, to provide respective blocks which were processed individually in a crusher to provide respective granules of 0.5 – 1.5 mm grain sizes. These three kinds granules, named as before P, Q and R, respectively, were mixed together in a ratio of 1 : 1 : 1. This powder mixture was hot-pressed in an inert atmosphere of argon and at 600°C in a mould with a pressure of 40 kg/cm². This processing mode is illustrated only schematically in FIG. 10.

When the thus sintered solid material was processed further as described in the foregoing Example 5, a beautiful and attractive product was obtained. It represented a marble-like outer appearance and similar sectional view, as shown only schematically at the lowest part of FIG. 10. It should be noted that in this case, the material flow in a diffusioned manner among the grains has been omitted for clear graphical representation of the drawing.

In this Example, part of the crushed materials can be replaced by aluminum alloy wire chips with similar results.

It should be mentioned that part or all of the aforementioned aluminum alloys may be replaced by that of any one of the members constituting the known group of the valve metals so-called, and such as Ti; V, Zr; Nb; Mo; Hf; Ta and W, although no specific Example thereof has been omitted by reason of easy occurrence to those skilled in the art upon read through the foregoing detailed description of the present invention. Aluminum is also a valve metal.

The embodiments of the invention in which an exclusive property or privilege is claimed are as follows:

1. A process for the manufacture of a decorative aluminum alloy product, comprising in combination:

a. bringing a plurality of different aluminum alloy material stocks into a mutually tightly contacting relationship so as to provide a composite stock;

b. subjecting this composite stock to a plastic deformation at least substantial part thereof, so as to provide therein an irregular flow pattern;

c. removing at least part of the surface of said composite stock by mechanical prefabrication so as to expose a new and decorative surface and to provide a semi-product;

d. subjecting said semiproduct to an anodically oxidizing step; and e. subjecting at least part of the thus treated semiproduct to a mirror-finishing step.

2. The process according to claim 1, wherein said anodically oxidized semiproduct is subjected to a dyeing step.

3. The process according to claim 1, wherein the alloy stocks are united together by pressure welding.

4. The process according to claim 1, wherein said alloy stocks are cut into chips and charged in a mould and brought into one composite piece by filling the idle gaps thereamong with a molten aluminum alloy of a further different alloy composition.

5. The process according to claim 1, wherein said alloy stocks are finely divided and semisintered separately, and the thus semisintered masses are crushed into small pieces which are mixed together and compacted under pressure at an elevated temperature into one piece to provide a composite stock.

6. The process according to claim 1, wherein said alloy stocks are finely divided into corresponding powders of 10–50 micron size particles, adding to one kind of powders a binder; processing said powder and binder into granules of 0.1–1.5 mm particle size; successively surrounding said granules with layers of the remaining alloy powders so as to produce concentric multilayer structures of 1.5–5.0 mm diameter; charging said structures into molds; and uniting said structures into a solid mass by compacting under pressure and sintering in an inert atmosphere at an elevated temperature thereby producing said composite stock.

* * * * *